US010824095B2

(12) United States Patent
Nakajima

(10) Patent No.: US 10,824,095 B2
(45) Date of Patent: Nov. 3, 2020

(54) TRANSPORTING MEMBER, DEVELOPING DEVICE, AND IMAGE FORMING APPARATUS

(71) Applicant: FUJI XEROX CO., LTD., Tokyo (JP)

(72) Inventor: Yoshitaka Nakajima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/286,527

(22) Filed: Feb. 26, 2019

(65) Prior Publication Data

US 2020/0096909 A1 Mar. 26, 2020

(30) Foreign Application Priority Data

Sep. 21, 2018 (JP) ..... 2018-178131

(51) Int. Cl.
*G03G 15/08* (2006.01)

(52) U.S. Cl.
CPC ..... *G03G 15/0891* (2013.01); *G03G 15/0889* (2013.01); *G03G 2215/0827* (2013.01); *G03G 2215/0838* (2013.01)

(58) Field of Classification Search
CPC ..... G03G 15/0891; G03G 15/0889; G03G 2215/0827
See application file for complete search history.

(56) References Cited

U.S. PATENT DOCUMENTS 9,458,879 B2 10/2016 Nakajima et al.
2004/0057755 A1* 3/2004 Yamaguchi ..... G03G 15/0893 399/256

FOREIGN PATENT DOCUMENTS

| | | |
|---|---|---|
| JP | 2004151326 | 5/2004 |
| JP | 2010256429 | 11/2010 |
| JP | 2014160162 | 9/2014 |

* cited by examiner

*Primary Examiner* — Walter L Lindsay, Jr.
*Assistant Examiner* — Andrew V Do
(74) *Attorney, Agent, or Firm* — JCIPRNET

(57) ABSTRACT

A transporting member includes a rotating shaft and plural helical blades that helically extend around the rotating shaft and that transport a transport object in a direction of the rotating shaft as the rotating shaft rotates, each helical blade including a downstream side surface at a downstream side in a transporting direction and an upstream side surface at a side opposite to the downstream side surface. A portion of at least one of the helical blades has a gap that enables the transport object to move in the direction of the rotating shaft, and the at least one of the helical blades includes an upstream section that extends upstream in a rotating-shaft rotation direction, in which the rotating shaft rotates, from the gap. The upstream section includes a portion in which an inclination angle of the downstream side surface is less than an inclination angle of the upstream side surface.

16 Claims, 11 Drawing Sheets

TRANSPORTING MEMBER, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2018-178131 filed Sep. 21, 2018.

BACKGROUND

(i) Technical Field

The present disclosure relates to a transporting member, a developing device, and an image forming apparatus.

(ii) Related Art

Japanese Unexamined Patent Application Publication No. 2010-256429 discloses a transport member including a multi-thread helical blade including plural helical blades that helically extend around the same rotating shaft and discontinuous portions that divide the multi-thread helical blade so that the multi-thread helical blade is discontinuous in an axial direction.

Japanese Unexamined Patent Application Publication No. 2014-160162 discloses a structure in which developer is divided into two streams by a discontinuous portion, and the developer in one of the two streams is transported while being separated from a downstream helical blade.

Japanese Unexamined Patent Application Publication No. 2004-151326 discloses a transport member including a blade portion having a blade surface with a largest blade surface angle and a blade portion having a blade surface with a small blade surface angle.

SUMMARY

An example of a transporting member that transports a transport object stirs the transport object while transporting the transport object. In such a case, the ability to transport the transport object is easily reduced when the ability to stir the transport object is increased, and the ability to stir the transport object is easily reduced when the ability to, transport the transport object is increased.

Aspects of non-limiting embodiments of the present disclosure relate to a transporting member with high ability to transport the transport object and high ability to stir the transport object.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transporting member including a rotating shaft and plural helical blades that helically extend around the rotating shaft and that transport a transport object in a direction of the rotating shaft as the rotating shaft rotates, each helical blade including a downstream side surface at a downstream side in a transporting direction and an upstream side surface at a side opposite to the downstream side surface. A portion of at least one of the helical blades has a gap that enables the transport object to move in the direction of the rotating shaft, and the at least one of the helical blades includes an upstream section that extends upstream in a rotating-shaft rotation direction, in which the rotating shaft rotates, from the gap. The upstream section includes a portion in which an inclination angle of the downstream side surface is less than an inclination angle of the upstream side surface.

BRIEF DESCRIPTION OF THE DRAWINGS

Exemplary embodiments of the present disclosure will be described in detail based on the following figures, wherein.

DETAILED DESCRIPTION

An exemplary embodiment of the present disclosure will now be described in detail with reference to the accompanying drawings.

Figure 1:
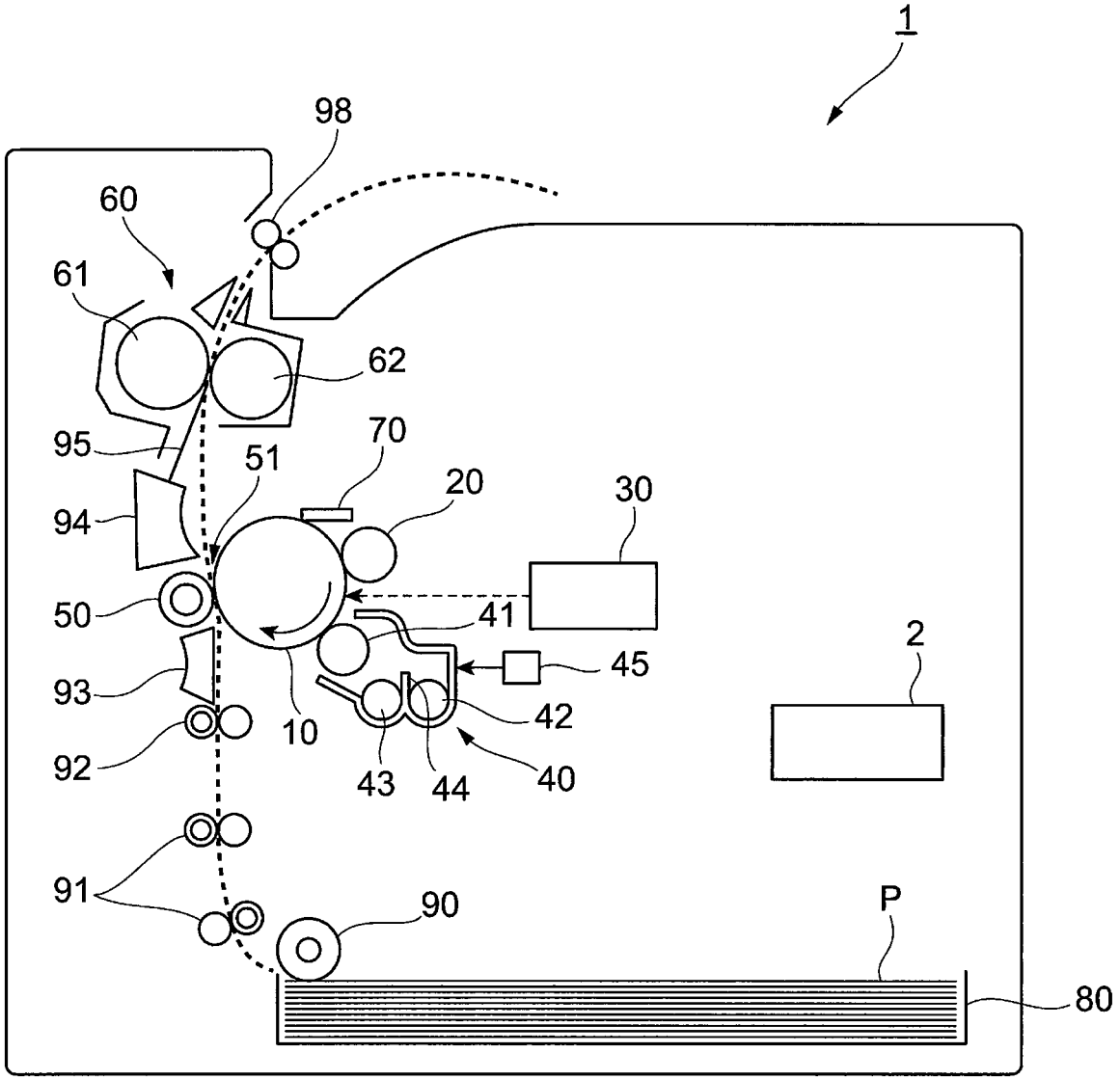
FIG. 1 illustrates the overall structure of an image forming apparatus.

FIG. 1 illustrates the overall structure of an image forming apparatus 1 according to the present exemplary embodiment.

The image forming apparatus 1 includes a controller 2, a photoconductor drum 10, a charging device 20, an exposure device 30, a developing device 40, a transfer device 50, a fixing device 60, a cleaning device 70, and a sheet storage unit 80.

The image forming apparatus 1 forms an image on a paper sheet P, which is an example of a recording medium, based on image information.

The controller 2 includes an arithmetic device, such as a central processing unit (CPU), and a memory, and controls the operations of units included in the image forming apparatus 1.

The photoconductor drum 10, which is an example of an image carrier, is cylindrical and carries a toner image formed on the outer peripheral surface thereof. The photoconductor drum 10 rotates in the direction indicated by the arrow.

The charging device 20 charges the photoconductor drum 10 by using, for example, a charging roller that rotates in contact with the surface of the photoconductor drum 10. The charging device 20 may instead charge the photoconductor drum 10 by a non-contact charging method by using, for example, corona discharge.

The exposure device 30 irradiates the surface of the photoconductor drum 10 charged by the charging device 20 with light corresponding to image data to form an electrostatic latent image on the surface of the photoconductor drum 10.

The thus-formed electrostatic latent image is moved toward the location of the developing device 40 as the photoconductor drum 10 rotates.

The developing device 40 forms an image on the photoconductor drum 10 by developing the electrostatic latent image formed on the photoconductor drum 10.

The developing device 40 includes a developing roller 41 that rotates. The developer (toner) on the surface of the developing roller 41 of the developing device 40 moves to a position at which the developing roller 41 faces the photoconductor drum 10. Accordingly, the electrostatic latent image formed on the photoconductor drum 10 is developed, so that an image (toner image) corresponding to the image information is formed on the surface of the photoconductor drum 10.

The image moves to the transfer device 50 as the photoconductor drum 10 rotates.

The developer is contained in the developing device 40.

The developer is so-called two-component developer. In the present exemplary embodiment, the developer contains toner and magnetic carrier. The toner is, for example, non-magnetic toner. However, magnetic toner may instead be used as long as the charging characteristics thereof differ from those of the magnetic carrier.

A first transport member 42, which transports the developer, and a second transport member 43, which also transports the developer, are disposed in the developing device 40.

A partition wall 44 is provided between the first transport member 42 and the second transport member 43. In the present exemplary embodiment, a supplying portion 45 that supplies new developer to the first transport member 42 is also provided.

An image carried by the photoconductor drum 10 (image formed on the surface of the photoconductor drum 10) is transferred onto the paper sheet P at the location of the transfer device 50.

A transfer nip portion 51 is formed at a position where the photoconductor drum 10 and the transfer device 50 face each other. The image on the photoconductor drum 10 is transferred onto the paper sheet P at the transfer nip portion 51.

The fixing device 60 includes a fixing roller 61 including a heat source and a pressing roller 62 that faces the fixing roller 61. The fixing device 60 applies pressure and heat to the paper sheet P to which the image has been transferred, and thereby fixes the image to the paper sheet P.

The cleaning device 70 is pressed against the photoconductor drum 10 to remove developer and the like that remain on the surface of the photoconductor drum 10.

The sheet storage unit 80 stores paper sheets P. The paper sheets P are fed from the sheet storage unit 80 and transported.

In the present exemplary embodiment, a feed roller 90 and transport rollers 91 are provided as mechanisms for feeding and transporting the paper sheets P. The feed roller 90 feeds the paper sheets P stored in the sheet storage unit 80. The transport rollers 91 transport the paper sheets P fed by the feed roller 90.

In addition, a registration roller 92 is provided to receive each paper sheet P that has been transported by the transport rollers 91 and feed the paper sheet P toward the transfer nip portion 51 at a predetermined timing.

In addition, guide members 93 and 94 and a guide 95 are also provided. The guide member 93 guides the paper sheet P fed by the registration roller 92 to the transfer nip portion 51. The guide member 94 guides the paper sheet P to which the image has been transferred to the fixing device 60.

In addition, a discharge roller 98 is provided to discharge the paper sheet P discharged from the fixing device 60 to the outside of the image forming apparatus 1.

Figure 2:
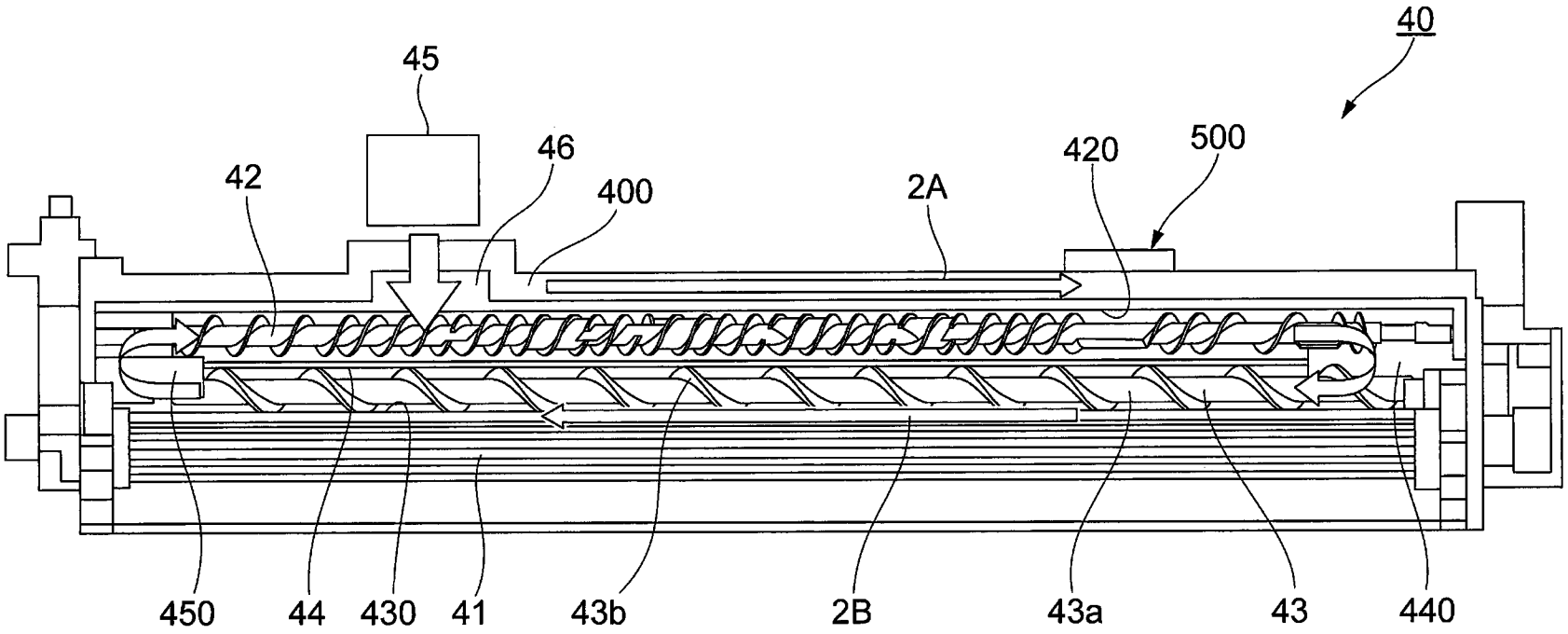
FIG. 2 is a top view of a developing device.

FIG. 2 is a top view of the developing device 40.

In FIG. 2, the transporting direction of the developer is indicated by the empty arrows.

The developing device 40 includes the developing roller 41, the first transport member 42, the second transport member 43, the partition wall 44, a developer container 400, and a toner density sensor unit 500, which is an example of a sensor. In the present exemplary embodiment, the supplying portion 45 that supplies new developer to the developing device 40 is provided.

The developing roller 41 holds the developer on the surface thereof. The developing roller 41 faces the photoconductor drum 10 illustrated in FIG. 1 and develops the electrostatic latent image formed on the photoconductor drum 10.

The developer container 400 has a stirring transport path 420 and a supplying transport path 430. In the present exemplary embodiment, the partition wall 44 is disposed between the stirring transport path 420 and the supplying transport path 430.

In the present exemplary embodiment, the first transport member 42 is disposed in the stirring transport path 420, and the second transport member 43 is disposed in the supplying transport path 430.

The developer container 400 has an opening 440 and an opening 450 at the ends thereof in the longitudinal direction. The opening 440 enables the developer to move from the stirring transport path 420 to the supplying transport path 430. The opening 450 enables the developer to move from the supplying transport path 430 to the stirring transport path 420.

In the present exemplary embodiment, the developing roller 41 and the supplying transport path 430 are substantially parallel to each other.

The developer container 400 has an inlet 46 for receiving the developer from the supplying portion 45. The inlet 46 is located between the central portion of the stirring transport path 420 and one end of the stirring transport path 420 in the longitudinal direction.

In the present exemplary embodiment, new developer from the supplying portion 45 is supplied to the stirring transport path 420 through the inlet 46. The supplied new developer is transported in the direction of arrow 2A in FIG. 2 while being stirred by the first transport member 42.

The developer that has been transported downstream along the stirring transport path 420 moves into the supplying transport path 430 through the opening 440. The developer that has moved into the supplying transport path 430 is transported in the direction of arrow 2B in FIG. 2 by the second transport member 43.

In the present exemplary embodiment, the developer that has been transported by the second transport member 43 moves into the stirring transport path 420 through the opening 450. The developer that has moved into the stirring transport path 420 is transported in the direction of arrow 2A in FIG. 2 by the first transport member 42.

In the present exemplary embodiment, transportation of the developer by the first transport member 42 and that by the second transport member 43 are repeatedly performed. Thus, in the present exemplary embodiment, the developer circulates in the developing device 40.

In the present exemplary embodiment, part of the developer that is transported by the second transport member 43 is supplied to the developing roller 41. The developing roller 41 supplies this developer to the surface of the photoconductor drum 10 (see FIG. 1).

The second transport member 43 includes a shaft 43*a* that rotates and a helical blade 43*b* having a helical shape that is provided on the shaft 43*a*.

The first transport member 42 includes a shaft and helical blades. The first transport member 42 will be describe in detail below.

In the present exemplary embodiment, the toner density sensor unit 500, which detects the density of the toner contained in the developer, is provided on the stirring transport path 420 of the developer container 400.

The toner density sensor unit 500 is disposed downstream of the inlet 46. The toner density sensor unit 500 is disposed between the central portion of the stirring transport path 420 and the other end of the stirring transport path 420 in the longitudinal direction.

In the present exemplary embodiment, the toner density sensor unit 500 is disposed downstream of the inlet 46 in the transporting direction of the developer.

In this case, the toner density sensor unit 500 detects the density of the toner in the developer after the new developer supplied through the inlet 46 is mixed with the developer that has already been contained.

In addition, in the present exemplary embodiment, the toner density sensor unit 500 is disposed upstream of the developing roller 41 in the transporting direction of the developer. Accordingly, the toner density sensor unit 500 detects the density of the toner contained in the developer before the developer reaches the developing roller 41.

In the present exemplary embodiment, the supplying portion 45 supplies new developer when the density of the toner detected by the toner density sensor unit 500 becomes lower than a predetermined density. The new developer is supplied to the stirring transport path 420 through the inlet 46.

Figure 3:
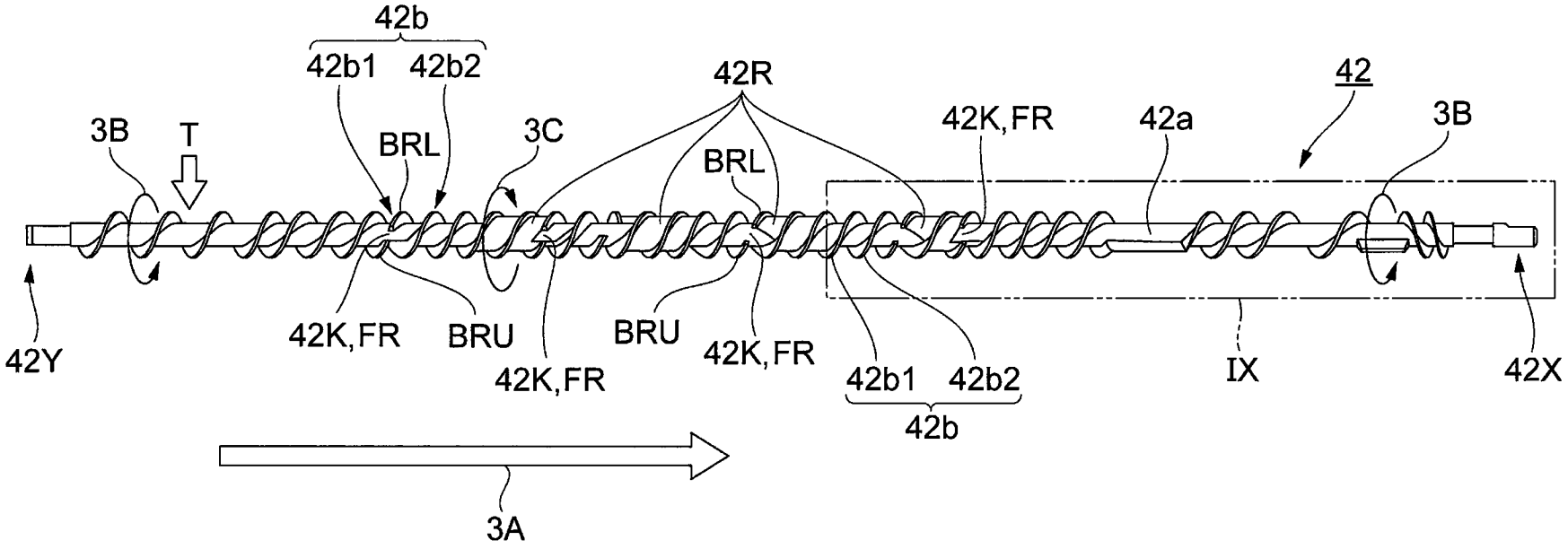
FIG. 3 illustrates a first transport member.

FIG. 3 illustrates the first transport member 42.

In FIG. 3, arrow 3A indicates the transporting direction of the developer. Also, in FIG. 3, solid arrows 3B indicate the rotation direction of the first transport member 42. In addition, in the present exemplary embodiment, the position at which the developer is supplied is denoted by T.

As illustrated in FIG. 3, the first transport member 42, which is an example of a transporting member, includes a cylindrical shaft 42*a*, which is an example of a rotating shaft.

The first transport member 42 also includes helical blades 42*b*, which include a first helical blade 42*b*1 and a second helical blade 42*b*2, around the shaft 42*a*. Thus, in the present exemplary embodiment, multiple helical blades are provided around the shaft 42*a*.

The first helical blade 42*b*1 and the second helical blade 42*b*2 are displaced from each other by 180° in the rotation direction of the shaft 42*a*.

When the shaft 42*a* is rotated by a drive source (not shown), the first transport member 42 transports the developer in the direction of arrow 3A (axial direction of the first transport member 42).

More specifically, in the present exemplary embodiment, when the shaft 42*a* is rotated in the direction of arrows 3B, the developer, which is an example of a transport object, performs a relative movement with respect to the shaft 42*a* in the direction of arrow 3C.

When the developer performs the relative movement, the developer comes into contact with the first helical blade 42*b*1 and the second helical blade 42*b*2. Accordingly, the developer changes the moving direction thereof and moves in the direction of arrow 3A.

More specifically, in the present exemplary embodiment, when the shaft 42*a* rotates in the direction of arrows 3B, the developer performs a relative movement with respect to the shaft 42*a* toward the upstream side in the rotation direction of the shaft 42*a*.

The developer that performs the relative movement is pushed by inclined portions of the first helical blade 42*b*1 and the second helical blade 42*b*2 (portions inclined with respect to the circumferential direction of the shaft 42*a*), and is transported toward a first end portion 42X of the shaft 42*a*.

In addition, in the present exemplary embodiment, the first helical blade 42*b*1 and the second helical blade 42*b*2 each have cuts 42K, which are examples of gaps, so that the first helical blade 42*b*1 and the second helical blade 42*b*2 each include discontinuous portions FR in which no helical blades are present.

According to the present exemplary embodiment, since the cuts 42K are formed, the developer that has been transported by the first helical blade 42*b*1 moves beyond the first helical blade 42*b*1 toward a second end portion 42Y of the shaft 42*a* (this will be described in detail below). Also, the developer that has been transported by the second helical blade 42*b*2 moves beyond the second helical blade 42*b*2 toward the second end portion 42Y of the shaft 42*a*.

The first helical blade 42*b*1 and the second helical blade 42*b*2 each include upstream sections BRL and downstream sections BRU.

The upstream sections BRL are portions located upstream of the cuts 42K in the rotation direction of the shaft 42*a* (rotating-shaft rotation direction), which is the direction indicated by arrows 3B.

The downstream sections BRU are portions located downstream of the cuts 42K in the rotation direction of the shaft 42*a*.

Figure 4A:
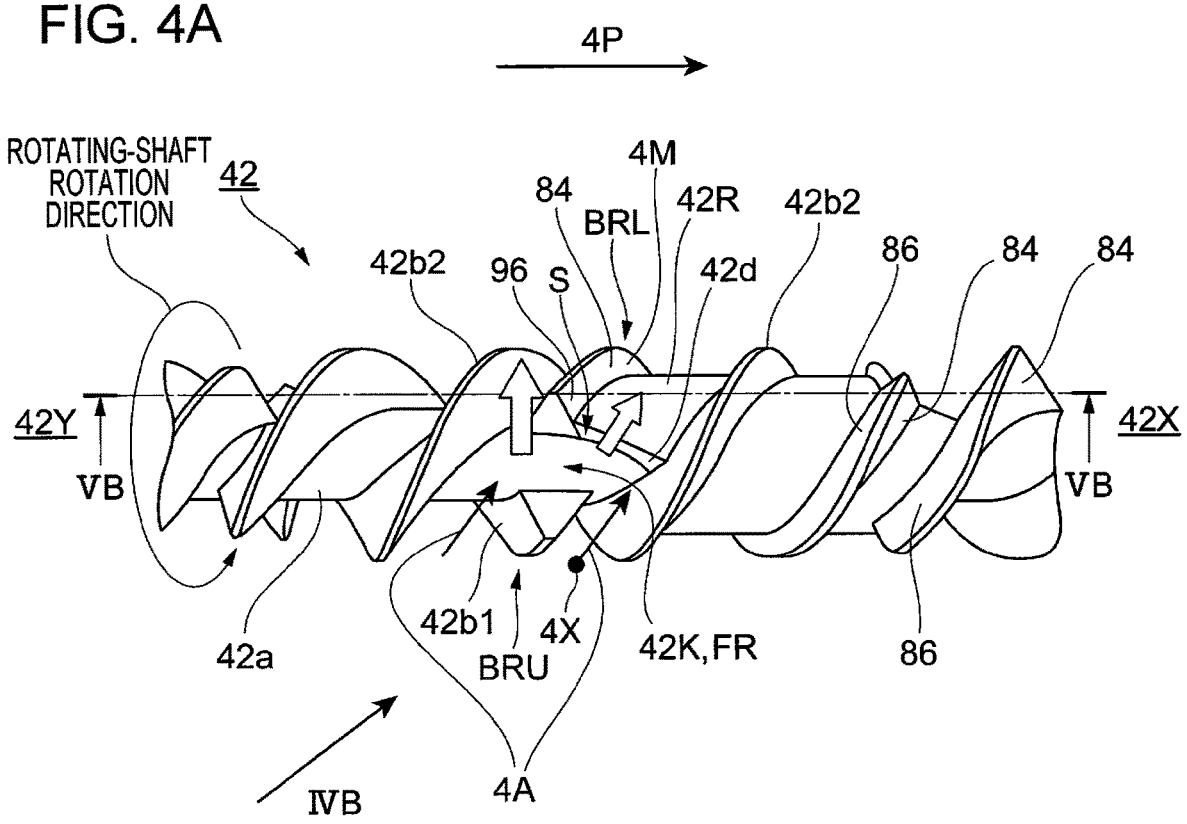
FIGS. 4A and 4B are enlarged partial views of the first transport member.
Figure 4B:
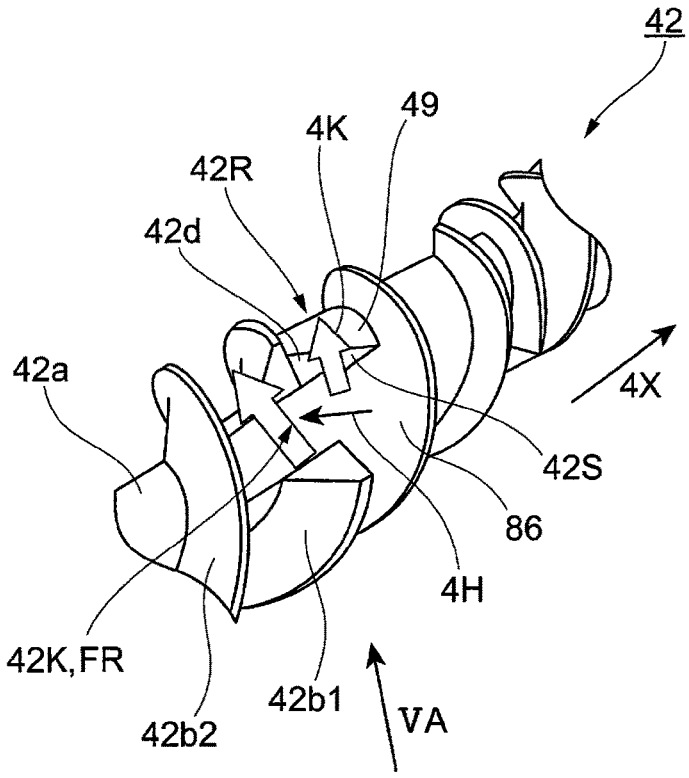

FIGS. 4A and 4B are enlarged partial views of the first transport member 42. FIG. 4A is a front view of the first transport member 42, and FIG. 4B is a perspective view of the first transport member 42 viewed in the direction of arrow IVB in FIG. 4A.

As illustrated in FIG. 4A, the first helical blade 42*b*1 and the second helical blade 42*b*2 each include a downstream side surface 84 and an upstream side surface 86.

The downstream side surface 84 is one of the two side surfaces of each of the first helical blade 42*b*1 and the second helical blade 42*b*2 that is located at a downstream side in the transporting direction of the developer (direction of arrow 4P). The upstream side surface 86 is the side surface at a side opposite to the downstream side surface 84.

In addition, in the present exemplary embodiment, regulating portions 42R that regulate the movement of the developer that performs the above-described relative movement are disposed between adjacent ones of the helical blades that are adjacent to each other in the axial direction of the first transport member 42 (between the first helical blade 42*b*1 and the second helical blade 42*b*2), as illustrated in 4A.

In the present exemplary embodiment, as the shaft 42*a* rotates, the developer performs a relative movement with respect to the shaft 42*a* to move upstream in the rotation direction of the shaft 42*a*, as shown by arrows 4A.

In the present exemplary embodiment, the developer that moves upstream in the rotation direction comes into contact with an end surface 42*d* of the regulating portion 42R, and the regulating portion 42R regulates the movement of part of the developer.

The regulating portions 42R (see FIG. 4A) are disposed between the adjacent ones of the helical blades.

More specifically, each regulating portion 42R is disposed between the first helical blade 42*b*1 located closer to the second end portion 42Y of the shaft 42*a* than the regulating portion 42R is and the second helical blade 42*b*2 located closer to the first end portion 42X of the shaft 42*a* than the regulating portion 42R is.

In addition, each regulating portion 42R is disposed upstream of a corresponding one of the cuts 42K in the rotation direction of the shaft 42*a* (rotating-shaft rotation direction).

In addition, in the present exemplary embodiment, each regulating portion 42R is disposed between a downstream end portion 96 of a corresponding one of the upstream sections BRL and the second helical blade 42*b*2, which is an example of another one of the helical blades.

Each of the upstream sections BRL according to the present exemplary embodiment includes the downstream end portion 96 at the downstream end thereof in the rotation direction of the shaft 42*a*.

Each regulating portion 42R is disposed between the downstream end portion 96 and the second helical blade 42*b*2, and extends upstream in the rotation direction of the shaft 42*a* from a region on a side of the downstream end portion 96.

Figure 5A:
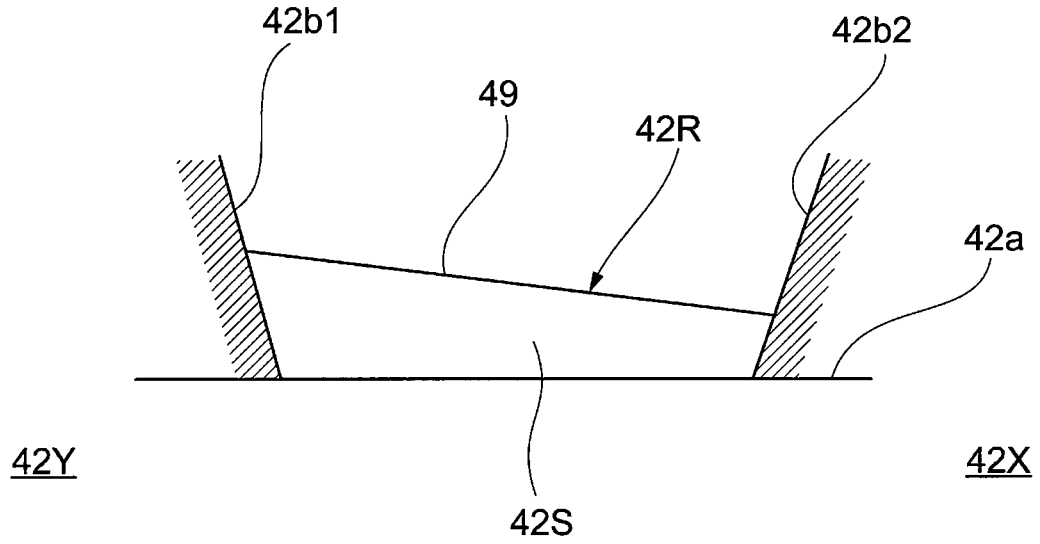
FIGS. 5A and 5B illustrate the shape of a regulating portion.
Figure 5B:
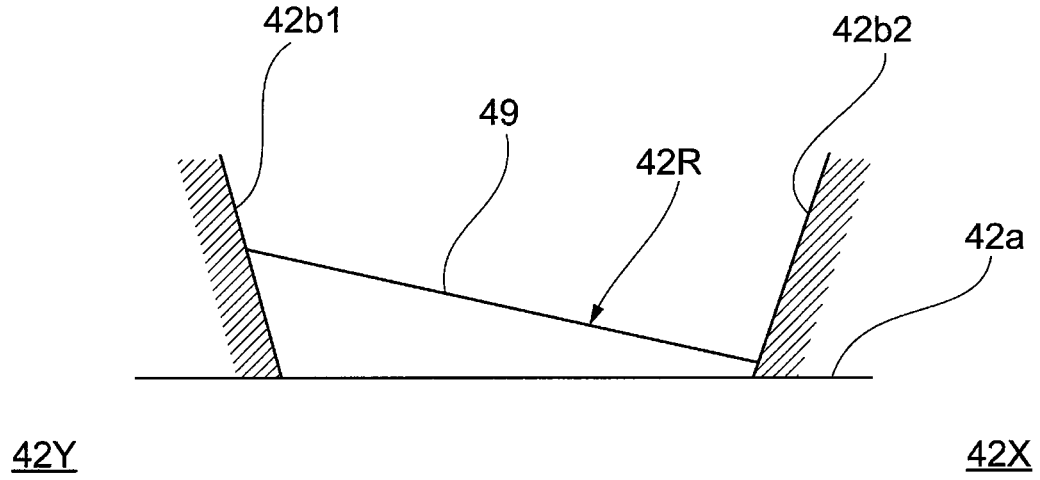

FIGS. 5A and 5B illustrate the shape of each regulating portion 42R.

FIG. 5A illustrates the regulating portion 42R viewed in the direction of arrow VA in FIG. 4B. FIG. 5B is a sectional view of the regulating portion 42R taken along line VB-VB in FIG. 4A.

As illustrated in FIG. 5A, in the present exemplary embodiment, the regulating portion 42R includes an outer surface 49 that is inclined downward toward the first end portion 42X of the shaft 42*a*.

More specifically, the outer surface 49 of the regulating portion 42R is inclined downward toward the first end portion 42X of the shaft 42*a* at an end portion 42S of the regulating portion 42R (see FIG. 4B), which is a downstream end portion in the rotation direction.

In the present exemplary embodiment, as illustrated in FIG. 5A, the entirety of the outer surface 49 is inclined. However, the outer surface 49 may instead be partially inclined.

In addition, in the present exemplary embodiment, as illustrated in FIG. 5B, the inclination of the outer surface 49 is increased at another portion of the regulating portion 42R.

More specifically, the inclination of the outer surface 49 of the regulating portion 42R is increased in a region upstream of the end portion 42S in the rotation direction of the shaft 42*a*.

More specifically, in the present exemplary embodiment, the inclination of the outer surface 49 of the regulating portion 42R gradually increases with increasing distance toward the upstream side in the rotation direction of the shaft 42*a*. Accordingly, as illustrated in FIG. 5B, the inclination of the outer surface 49 of the regulating portion 42R is increased at a portion other than the end portion 42S of the regulating portion 42R.

In this specification, the term "inclination" means an inclination with respect to the axial direction of the first transport member 42.

In addition, in this specification, the term "inclination angle" means an angle with respect to the axial direction of the first transport member 42, more specifically, an acute angle that is the smaller one of two angles (acute angle that is small and obtuse angle that is large) with respect to the axial direction.

In the present exemplary embodiment, as described above, the developer performs a relative movement with respect to the shaft 42*a* to move upstream in the rotation direction of the shaft 42*a*. At this time, in the present exemplary embodiment, the movement of the developer is regulated by the regulating portion 42R.

More specifically, in the present exemplary embodiment, when the developer at the position denoted by 4X (see FIG. 4A) moves upstream in the rotation direction of the shaft 42*a* and reaches the regulating portion 42R, movement of part of the developer is regulated.

In the present exemplary embodiment, the developer whose movement has been regulated moves in the direction of arrow 4H in FIG. 4B and passes through the cut 42K toward the region on the left side of the cut 42K in FIG. 4B.

Accordingly, in the present exemplary embodiment, part of the developer transported by the first helical blade 42*b*1 joins the developer transported by the second helical blade 42*b*2, which is another helical blade. As a result, the developer is more effectively stirred than when the developer is transported by a single helical blade.

In addition, in the present exemplary embodiment, another part of the developer moves downstream through the region that faces the outer surface 49 of the regulating portion 42R, as shown by arrow 4K in FIG. 4B.

As described above, in the present exemplary embodiment, the outer surface 49 of the regulating portion 42R is inclined downward toward the first end portion 42X of the shaft 42*a*. Accordingly, in the present exemplary embodiment, the other part of the developer also receives a transporting force and moves downstream.

If the outer surface 49 of the regulating portion 42R is not inclined, the other part of the developer receives the transporting force only from the downstream side surface 84 of the first helical blade 42*b*1 (portion denoted by 4M in FIG. 4A).

In contrast, when the outer surface 49 of the regulating portion 42R is inclined as in the present exemplary embodiment, the regulating portion 42R also applies a transporting force, so that the transporting force applied to the developer in the downstream direction is increased.

In addition, in the present exemplary embodiment, as described above, the inclination of the outer surface 49 is increased in a region upstream of the end portion 42S of the regulating portion 42R in the rotation direction of the shaft 42*a*. Therefore, the transporting force applied to the developer is increased in the region upstream of the end portion 42S of the regulating portion 42R.

In the present exemplary embodiment, the inclination of the outer surface 49 is reduced (cross-sectional area of the regulating portion 42R is increased) in the region near the cut 42K (at the end portion 42S of the regulating portion 42R), so that a sufficient amount of developer moves toward the cut 42K.

Also, the inclination of the outer surface 49 is increased (cross-sectional area of the regulating portion 42R is reduced) in the region upstream of the end portion 42S in the rotation direction of the shaft 42*a*, so that the transporting force applied to the developer is increased.

Figure 6:
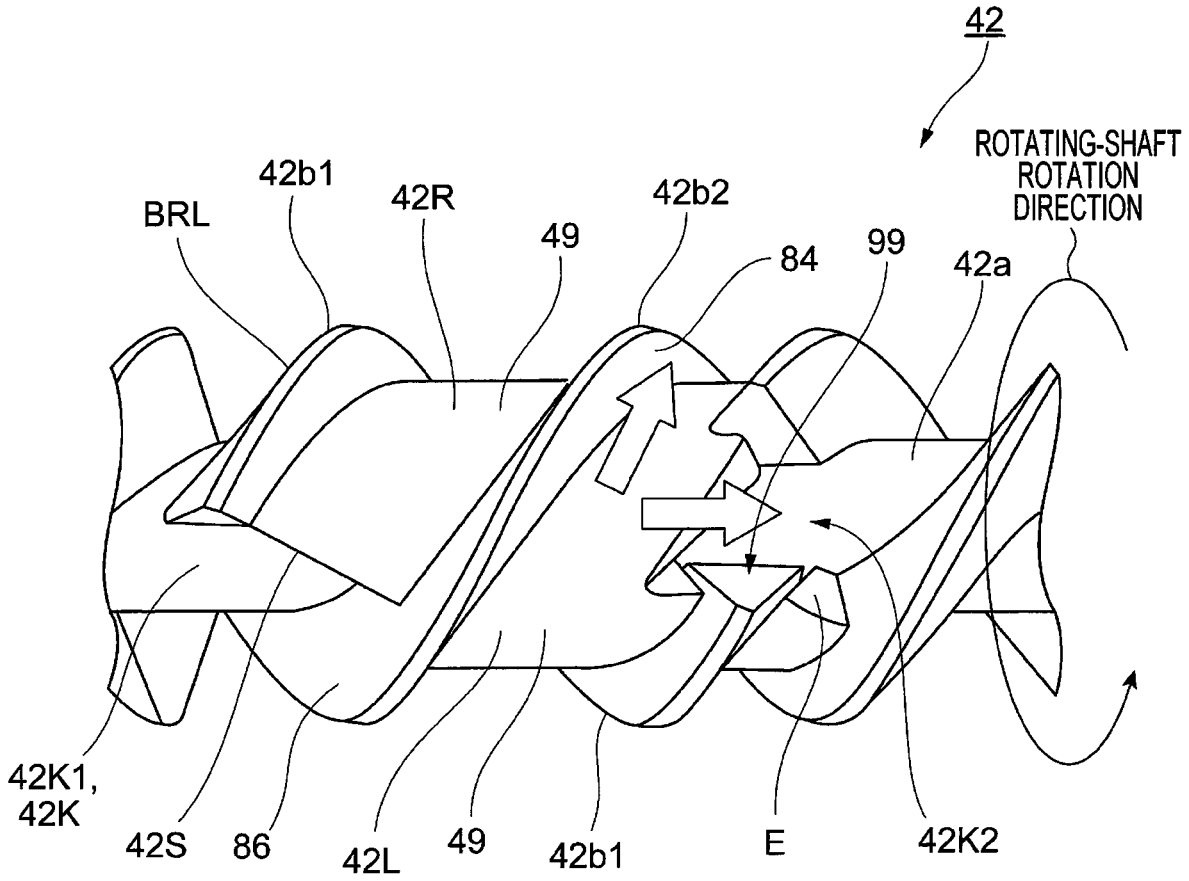
FIG. 6 illustrates an end point of the regulating portion.

FIG. 6 illustrates an end point E of the regulating portion 42R.

The end point E of the regulating portion 42R is located downstream of the above-described end portion 42S (start point) in the transporting direction of the developer. In addition, the end point E is located upstream of the end portion 42S in the rotation direction of the shaft 42*a*.

The position of the end point E in the rotation direction of the shaft 42*a* coincides with the position of an upstream end portion 99 of the upstream section BRL.

In addition, as illustrated in FIG. 6, the first helical blade 42*b*1 according to the present exemplary embodiment has a second cut 42K2 that is located upstream of the above-described cut 42K (hereinafter referred to as a "first cut 42K1") in the rotation direction of the rotating shaft 42*a*. The second cut 42K2 enables the developer to move in the axial direction of the first transport member 42.

In this specification, the first cut 42K1 and the second cut 42K2 are referred to simply as cuts 42K when they are not distinguished from each other, and as the first cut 42K1 and the second cut 42K2 when they are distinguished from each other.

In the present exemplary embodiment, a portion of the first helical blade 42*b*1 between the first cut 42K1 and the second cut 42K2 has a length corresponding to one pitch. Similarly, the regulating portion 42R also has a length corresponding to one pitch.

In other words, in the present exemplary embodiment, the portion of the first helical blade 42*b*1 between the first cut 42K1 and the second cut 42K2 and the regulating portion 42R extend one turn around the rotating shaft 42*a* in the circumferential direction.

As illustrated in FIG. 6, in the present exemplary embodiment, the regulating portion 42R is not provided and the shaft 42*a* is exposed in a region upstream of the end point E in the rotation direction of the rotating shaft 42*a*.

In addition, in the present exemplary embodiment, a regulating portion 42L is provided between the second helical blade 42*b*2 and the first helical blade 42*b*1 in a region on the left side of the second cut 42K2 in FIG. 6.

The start point of the regulating portion 42L is located behind the end portion 42S illustrated in FIG. 6 (start point of the regulating portion 42R). More specifically, the start point of the regulating portion 42L is located opposite the start point of the regulating portion 42R with the shaft 42*a* provided therebetween.

As illustrated in FIG. 6, the regulating portion 42R is not provided in the region upstream of the end point E of the regulating portion 42R in the rotation direction of the shaft 42*a*. The developer that has been transported through the region that faces the outer surface 49 of the regulating portion 42R and reached the end point E is transported further downstream through the region in which the regulating portion 42R is not provided.

In addition, in the present exemplary embodiment, part of the developer that has been transported through a region that faces an outer surface 49 of the regulating portion 42L and reached a region on a side of the second cut 42K2 passes through the second cut 42K2 and moves to the region in which the regulating portion 42R is not provided.

Thus, in the present exemplary embodiment, the developer that has been transported through the region that faces the outer surface 49 of the regulating portion 42L merges with the developer that has been transported through the region that faces the outer surface 49 of the regulating portion 42R.

Figure 7:
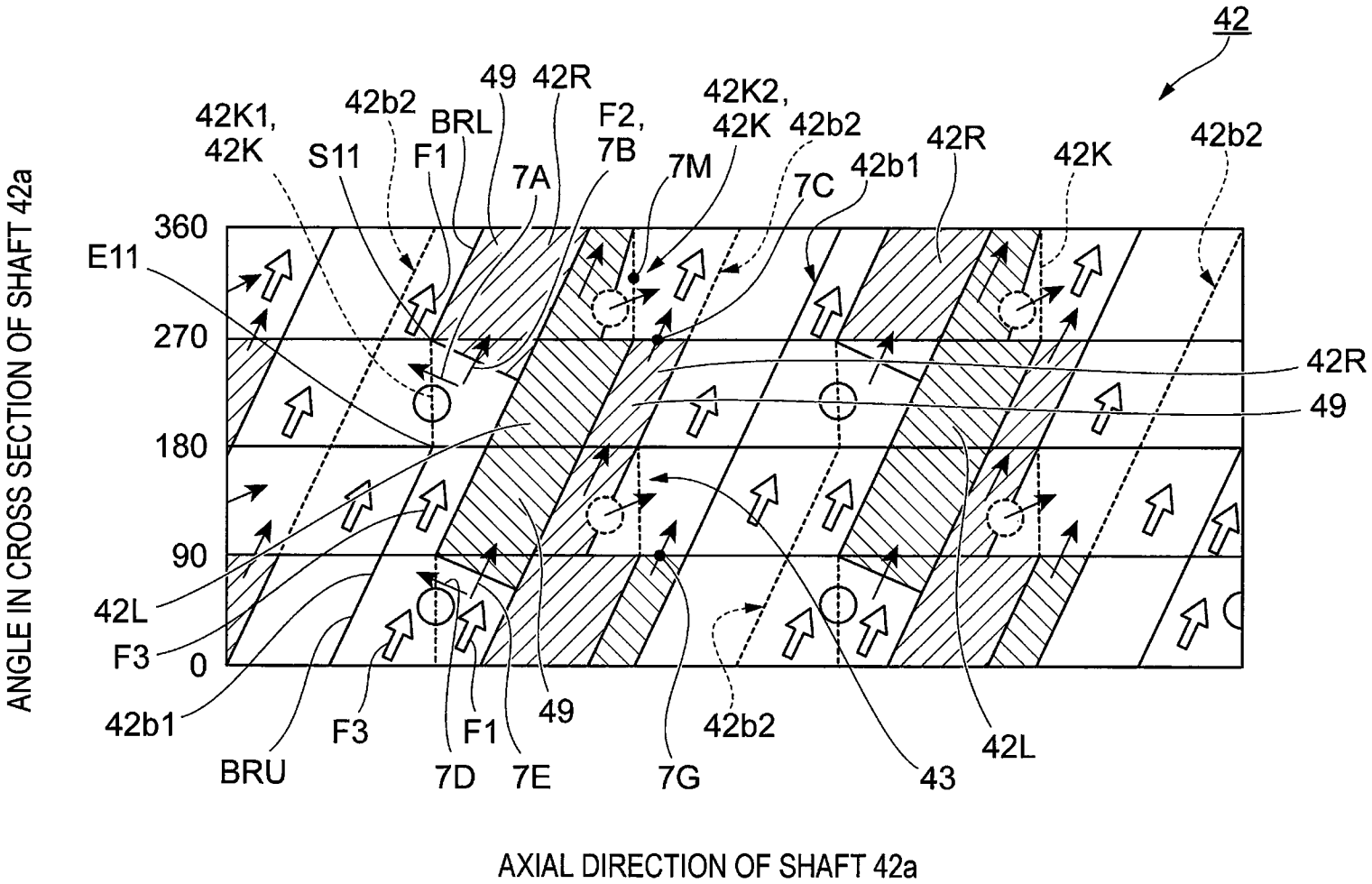
FIG. 7 is a development view of an outer peripheral surface of the first transport member.

FIG. 7 is a development view of the outer peripheral surface of the first transport member 42.

In the present exemplary embodiment, as described above, the developer performs a relative movement to move upstream in the rotation direction of the rotating shaft 42*a*.

Each regulating portion 42R regulates the movement of part of the developer, and this part of the developer moves in the direction of arrow 7A.

This developer merges with the developer that has been transported by the second helical blade 42*b*2, and then moves in the direction of arrow F1.

Another part of the developer that has reached the regulating portion 42R moves downstream through the region that faces the outer surface 49 of the regulating portion 42R, as shown by arrow F2 (arrow 7B).

In the present exemplary embodiment, as described above, the outer surface 49 is inclined. Therefore, the developer is more easily transported downstream than when the outer surface 49 is not inclined.

After that, the developer that has passed through the region that faces the outer surface 49 of the regulating portion 42R reaches the position denoted by 7C, and merges with the developer that has passed through the second cut 42K2 (developer that has passed through the region that faces the outer surface 49 of the regulating portion 42L and then through the second cut 42K2).

Each regulating portion 42L is similarly configured. In the present exemplary embodiment, each regulating portion 42L regulates the movement of part of the developer, and this part of the developer moves in the direction of arrow 7D. This developer merges with the developer that has been transported by the first helical blade 42*b*1, and then moves in the direction of arrow F3.

Another part of the developer that has reached the regulating portion 42L moves downstream through the region that faces the outer surface 49 of the regulating portion 42L, as shown by arrow 7E. This outer surface 49 is also inclined so that the developer is easily transported downstream.

After that, the developer that has passed through the region that faces the outer surface 49 of the regulating portion 42L reaches the position denoted by 7M or the position denoted by 7G.

The developer that has reached the position denoted by 7M merges with the developer that has passed through the region that faces the outer surface 49 of the regulating portion 42R and reached the position denoted by 7C.

The developer that has reached the position denoted by 7G merges with the developer that has passed through a cut 43 (cut formed in the second helical blade 42*b*2), that is, the developer that has been transported through the region that faces the outer surface 49 of the regulating portion 42R.

In the present exemplary embodiment, as illustrated in FIG. 7, a start point S11 of each upstream section BRL and an end point E11 of the corresponding downstream section BRU are at the same position in the axial direction of the first transport member 42.

In other words, in the present exemplary embodiment, the position of the start point S11 of each upstream section BRL in the axial direction coincides with the position of the end point E11 of the corresponding downstream section BRU in the axial direction.

Figure 8B:
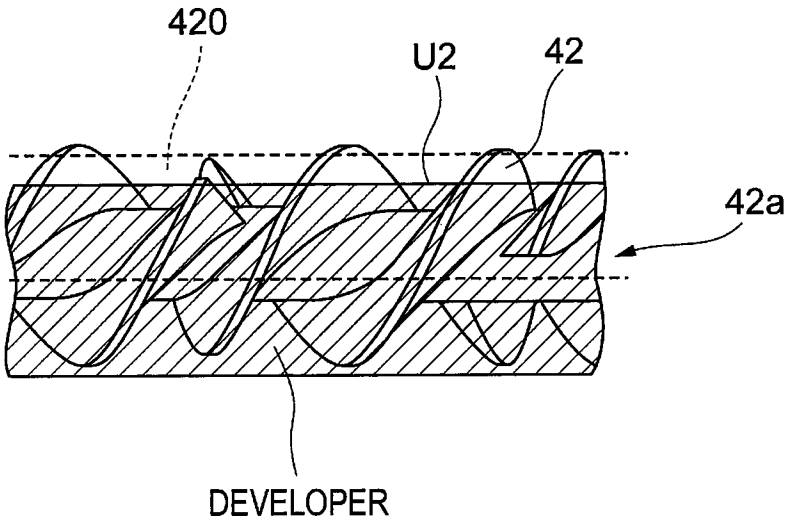
FIGS. 8A and 8B illustrate developer transported along a stirring transport path.
Figure 8A:
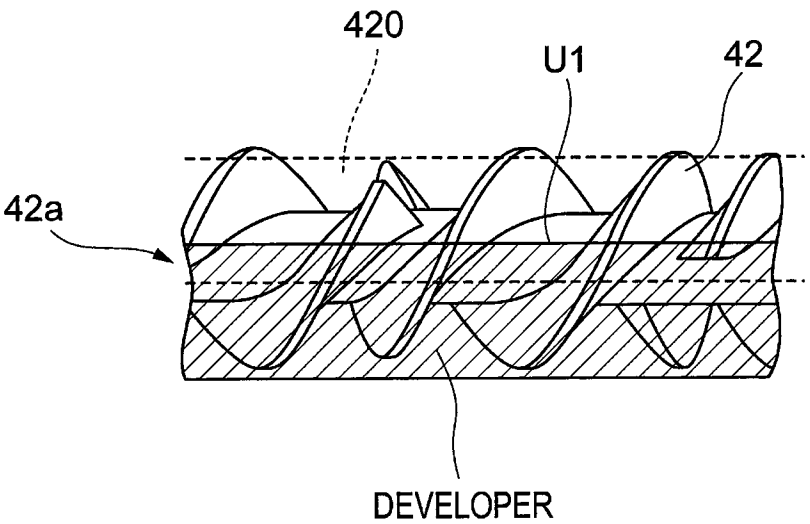

FIGS. 8A and 8B illustrate the developer transported along the stirring transport path 420.

FIG. 8A illustrates the developer transported by the first transport member 42 that does not include the regulating portion 42R and the regulating portion 42L, and FIG. 8B illustrates the developer transported by the first transport member 42 that includes the regulating portion 42R and the regulating portion 42L.

As illustrated in FIG. 8B, when the first transport member 42 includes the regulating portion 42R and the regulating portion 42L, the transporting force applied to the developer is reduced due to the regulating portion 42R and the regulating portion 42L, and therefore a top surface U2 of the developer is raised. In this case, the developer is easily dispersed in the circumferential direction of the first transport member 42.

In contrast, as illustrated in FIG. 8A, when the first transport member 42 does not include the regulating portion 42R and the regulating portion 42L, a top surface U1 of the developer is lowered, and accordingly the developer is not easily dispersed in the circumferential direction of the first transport member 42.

As illustrated in FIG. 7, in the present exemplary embodiment, plural regulating portions 42R and plural regulating portions 42L are provided. The regulating portions 42R and the regulating portions 42L are arranged with predetermined intervals therebetween. Accordingly, the developer is transported downstream and the ability to transport the developer is not greatly reduced.

More specifically, in the present exemplary embodiment, as illustrated in FIG. 7, the regulating portions 42R are arranged at intervals corresponding to one pitch. In other words, a portion that is free from the regulating portions 42R extends between adjacent ones of the regulating portions 42R over a length corresponding to one pitch. Accordingly, the developer is transported and the ability to transport the developer is not greatly reduced.

Similarly, the regulating portions 42L are also arranged at intervals corresponding to one pitch. In other words, a portion that is free from the regulating portions 42L extends between adjacent ones of the regulating portions 42L over a length corresponding to one pitch. Accordingly, the developer is transported and the ability to transport the developer is not greatly reduced.

The number of regulating portions 42R and the number of regulating portions 42L are not particularly limited, and may be either one or more than one.

The regulating portions 42R and 42L may be closer to the first end portion 42X (see FIG. 3) than the inlet 46 (see FIG. 2) is in the axial direction of the first transport member 42. In other words, the regulating portions 42R and 42L may be disposed downstream of the inlet 46 in the transporting direction of the developer.

Although the structure in which the first transport member 42 includes two helical blades is described above as an example, the first transport member 42 may instead include three or more helical blades.

In addition, although the structure in which the first transport member 42 is provided with the cuts 42K, the regulating portions 42R, and the regulating portions 42L is described above as an example, the second transport member 43 may also be provided with the cuts 42K, the regulating portions 42R, and the regulating portions 42L.

The positions of the cuts 42K will now be described.

Figure 9:
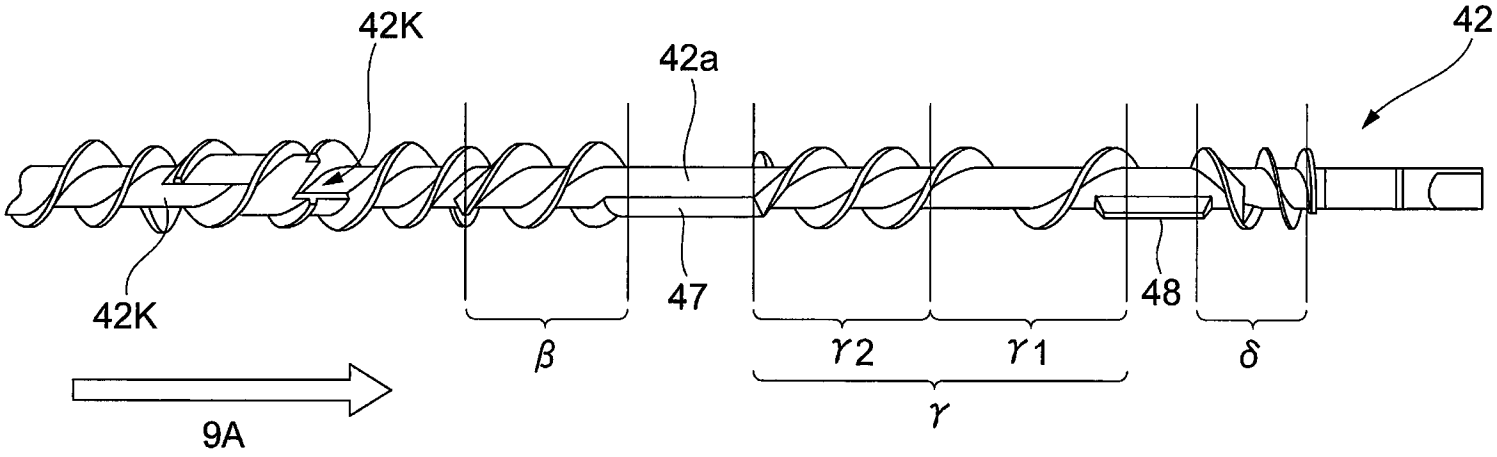
FIG. 9 is an enlarged view of part IX in FIG. 3.

FIG. 9 is an enlarged view of part IX in FIG. 3. In FIG. 9, arrow 9A indicates the transporting direction of the developer.

As illustrated in FIG. 9, a cleaning portion 47 and a discharging portion 48 are provided around the shaft 42*a* of the first transport member 42.

The cleaning portion 47, which is a functional portion that cleans a sensing surface of the toner density sensor unit 500 (see FIG. 2), faces the toner density sensor unit 500. No helical blades are provided in the region in which the cleaning portion 47 is provided, and accordingly the ability to transport the developer is low.

The discharging portion 48, which is disposed downstream of the cleaning portion 47 in the transporting direction of the developer, discharges the developer that has been transported thereto toward the second transport member 43 (see FIG. 2). More specifically, the discharging portion 48 pushes the developer that has been transported thereto toward the opening 440.

The region denoted by β in FIG. 9 is located upstream of the cleaning portion 47 and has a length corresponding to one pitch. The region denoted by γ in FIG. 9 extends from the downstream end of the cleaning portion 47 to the upstream end of the discharging portion 48. This region γ includes a region γ1 adjacent to the discharging portion 48 and a region γ2 adjacent to the cleaning portion 47.

The region δ illustrated in FIG. 9 is a region that is adjacent to the discharging portion 48 at a side opposite to the side at which the region γ1 is provided.

A helical blade that is wound in a direction opposite to the winding direction (turning direction) of the helical blades in the region upstream of the discharging portion 48 is provided in the region δ. The helical blade wound in the opposite direction causes the developer that has reached the region δ to move backward toward the discharging portion 48.

In the present exemplary embodiment, the helical blades provided in the regions β and γ have no cuts 42K.

A single helical blade is provided in the region γ1. When only one helical blade is present in a cross section that is orthogonal to the shaft 42*a*, it may be said that this cross section has a single helical blade.

The cuts 42K, which promote stirring of the developer, tend to make the transport speed of the developer and the amount of transportation of the developer non-uniform.

When the cuts 42K are provided near the cleaning portion 47, the transport speed and the amount of transportation of the developer that passes through the toner density sensor unit 500 tend to be non-uniform. In such a case, the toner density sensor unit 500 cannot easily perform reliable detection of the toner density.

Accordingly, in the present exemplary embodiment, no cuts 42K are provided in the helical blades in a region that is upstream of and adjacent to the cleaning portion 47 and that has a length corresponding to one pitch. As a result, the transport speed and the amount of transportation of the developer that passes through the toner density sensor unit 500 is more uniform than when the cuts 42K are provided.

In addition, in the present exemplary embodiment, the helical blade provided in the region γ also has no cuts 42K. Thus, the amount of developer discharged by the discharging portion 48 is more uniform than when the cuts 42K are provided.

Figure 10:
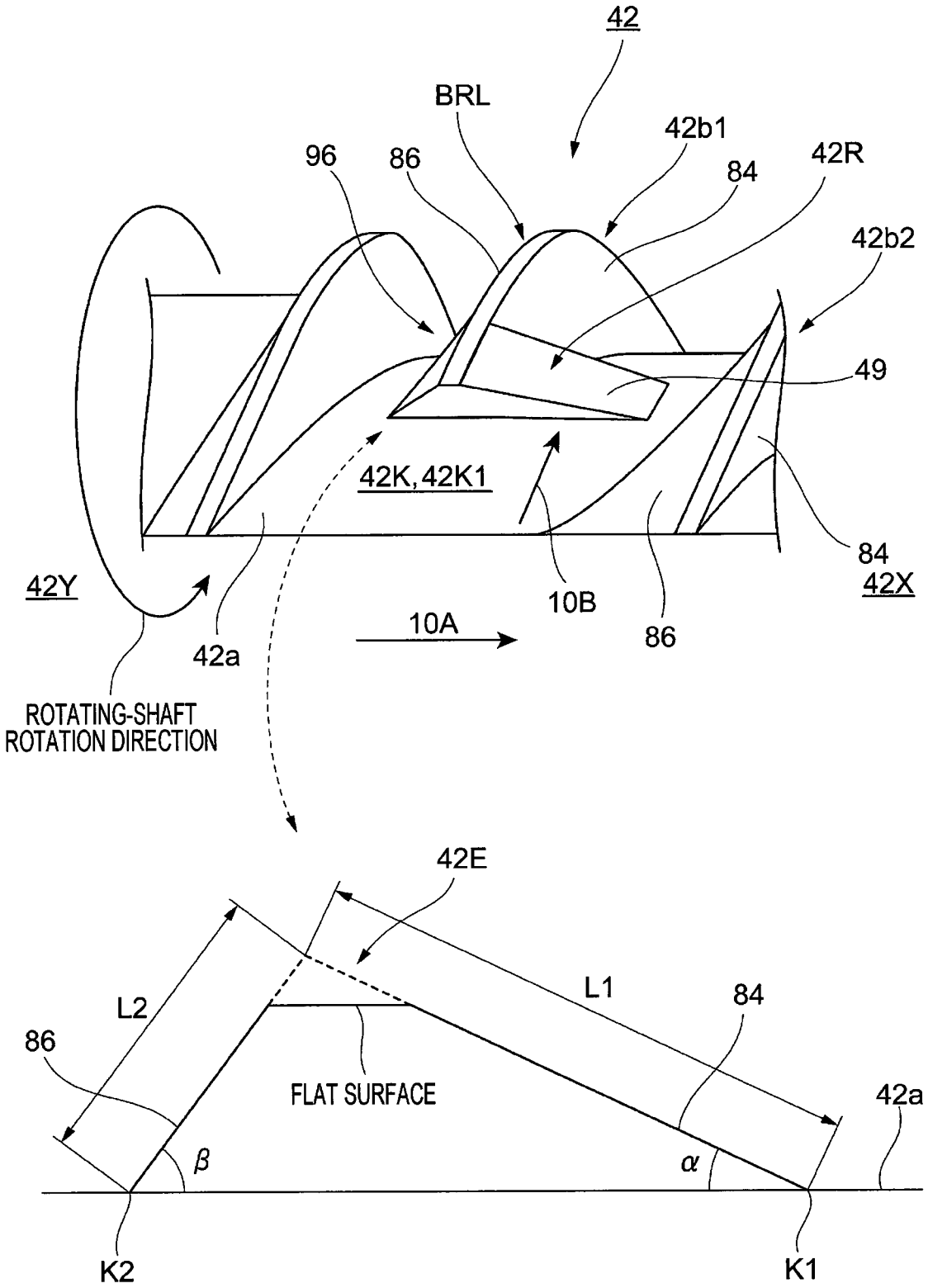
FIG. 10 illustrates another exemplary structure of the first transport member.

FIG. 10 illustrates another exemplary structure of the first transport member 42. The structure described below includes upstream sections BRL having a shape that differs from that in the above-described structure, but is similar to the above-described structure in other respects. In the following description, the first helical blade 42*b*1 and the second helical blade 42*b*2 are referred to simply as helical blades 42*b* when they are not distinguished from each other.

Also in the exemplary structure illustrated in FIG. 10, the first helical blade 42*b*1 and the second helical blade 42*b*2 each include a downstream side surface 84 at a downstream side in the transporting direction of the developer and an upstream side surface 86 at a side opposite to the downstream side surface 84.

The downstream side surface 84 is formed such that the height thereof decreases with increasing distance toward the first end portion 42X of the first transport member 42, and the upstream side surface 86 is formed such that the height thereof decreases with increasing distance toward the second end portion 42Y of the first transport member 42.

More specifically, in this exemplary embodiment, the developer is transported in the direction of arrow 10A as the shaft 42*a* rotates. The downstream side surface 84 is provided at a downstream side in the transporting direction of the developer, and the upstream side surface 86 is provided upstream of the downstream side surface 84.

The first helical blade 42*b*1 and the second helical blade 42*b*2 each have a triangular cross section, and a vertex portion 42E is provided between the upstream side surface 86 and the downstream side surface 84.

In the present exemplary embodiment, an inclination angle α of the downstream side surface 84 is smaller than an inclination angle β of the upstream side surface 86 at a portion of each upstream section BRL that is positioned adjacent to the corresponding cut 42K (first cut 42K1).

In other words, in the present exemplary embodiment, the inclination angle of the downstream side surface 84 is smaller than the inclination angle of the upstream side surface 86 at the downstream end portion 96 of the upstream section BRL.

More specifically, in the present exemplary embodiment, the downstream side surface 84 extends downstream in the transporting direction of the developer by a long distance at the downstream end portion 96.

Thus, in the present exemplary embodiment, a section of the downstream end portion 96 on which the downstream side surface 84 is provided functions as the regulating portion 42R.

More specifically, in the present exemplary embodiment, a downstream side distance L1, which is the distance between the vertex portion 42E of the upstream section BRL and a downstream intersection K1, is greater than an upstream side distance L2, which is the distance between the vertex portion 42E and an upstream intersection K2.

The downstream intersection K1 is the point at which the downstream side surface 84 and the outer peripheral surface of the shaft 42*a* intersect. The upstream intersection K2 is the point at which the upstream side surface 86 and the outer peripheral surface of the shaft 42*a* intersect.

The vertex portion 42E is a portion of each helical blade 42*b* that is farthest from the outer peripheral surface of the shaft 42*a*. When the vertex portion 42E has a flat surface that extends in the axial direction as illustrated in FIG. 10, the intersection between the extension of the downstream side surface 84 and the extension of the upstream side surface 86 is regarded as the vertex portion.

In the present exemplary embodiment, similar to the above-described case, the developer that performs a relative movement moves upstream in the rotation direction of the shaft 42*a*, and the movement of the developer is regulated by the regulating portion 42R. More specifically, as shown by arrow 10B, the movement of the developer that tries to move upstream through the space between the first helical blade 42*b*1 and the second helical blade 42*b*2 is regulated by the section of the downstream end portion 96 on which the downstream side surface 84 is provided.

Accordingly, similar to the above-described case, part of the developer moves toward the cut 42K, and another part of the developer passes through the region that faces the outer surface 49 of the regulating portion 42R and moves upstream in the rotation direction of the shaft 42*a*.

In addition, also in the present exemplary embodiment, similar to the above-described case, the outer surface 49 of the regulating portion 42R (downstream side surface 84) is inclined downward so that the developer receives a transporting force that transports the developer in the axial direction of the first transport member 42.

Figure 11A:
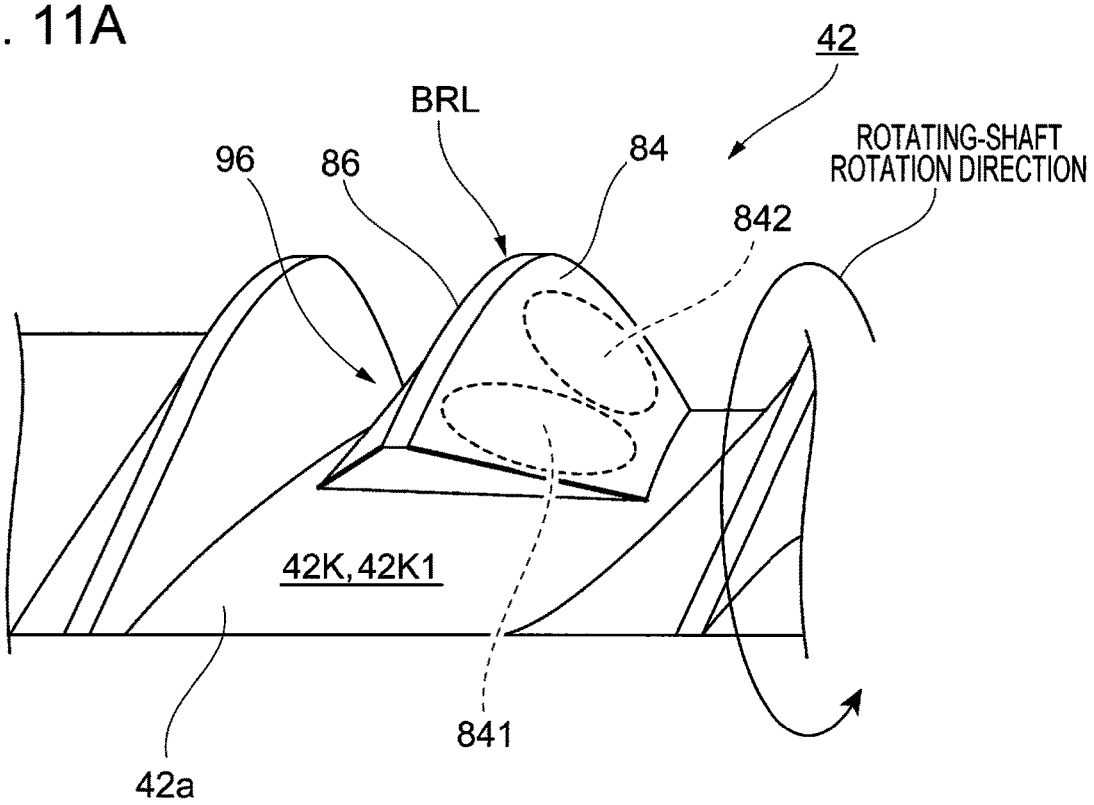
FIGS. 11A and 11B illustrate other exemplary structures of the first transport member.
Figure 11B:
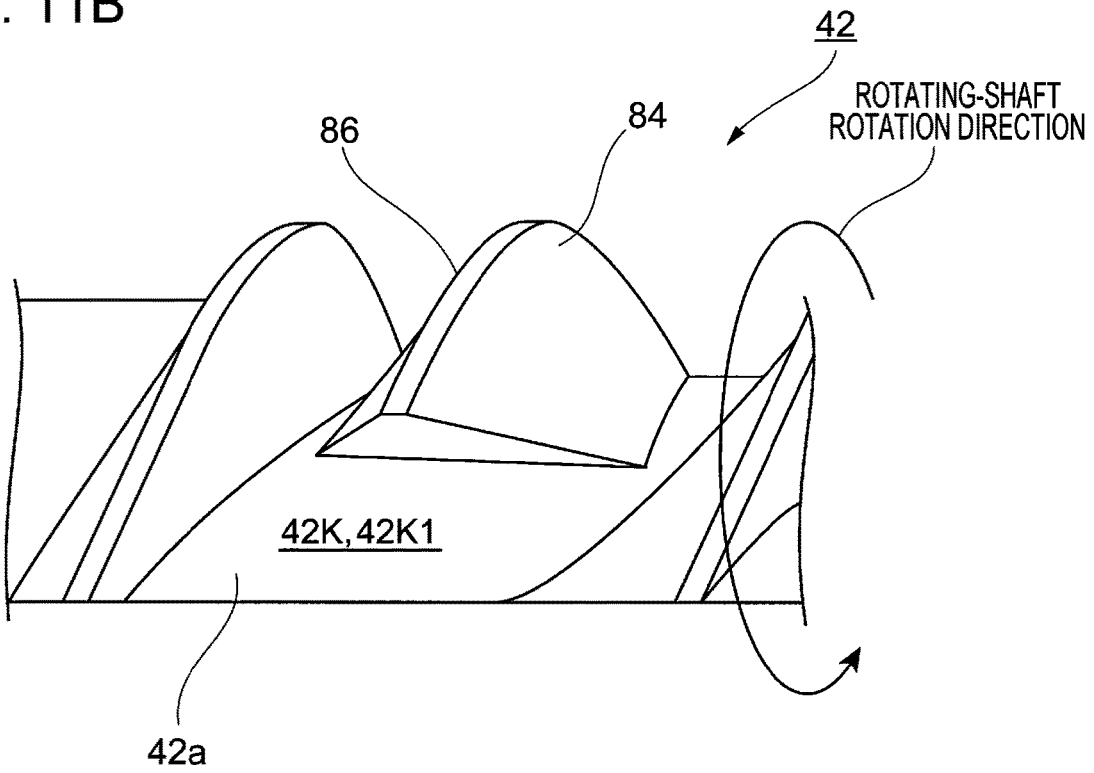

FIGS. 11A and 11B illustrate other exemplary structures of the first transport member 42.

In the exemplary structure illustrated in FIG. 11A, the inclination angle of the downstream side surface 84 gradually increases with increasing distance from the position adjacent to the cut 42K toward the upstream side in the rotation direction of the shaft 42*a*.

In other words, in this exemplary structure, the inclination angle of the downstream side surface 84 gradually increases with increasing distance from the position of the downstream end portion 96 toward the upstream side in the rotation direction of the shaft 42*a*.

Namely, in the present exemplary embodiment, the downstream side surface 84 includes a portion having an inclination angle that increases with increasing distance toward the upstream side in the rotation direction of the shaft 42*a*.

More specifically, in this exemplary structure, the downstream side surface 84 of the upstream section BRL includes a first portion 841 that is inclined and a second portion 842 that is also inclined.

The second portion 842 is closer to the second cut 42K2 (see FIG. 6) than the first portion 841 is. In other words, the second portion 842 is disposed upstream of the first portion 841 in the rotation direction of the shaft 42*a*. In addition, in this exemplary structure, the inclination angle of the second portion 842 is greater than the inclination angle of the first portion 841.

Thus, in this exemplary structure, the downstream side surface 84 includes the first portion 841 and the second portion 842 having different inclination angles in a region between the first cut 42K1 and the second cut 42K2.

In addition, in this exemplary structure, the inclination angle of the downstream side surface 84 increases with increasing distance toward the upstream side in the rotation direction of the shaft 42*a*, and finally becomes equal to the inclination angle of the upstream side surface 86.

Thus, the inclination angle of the downstream side surface 84 is equal to the inclination angle of the upstream side surface 86 at the upstream end portion 99 (see FIG. 6) of the upstream section BRL (in the region immediately in front of the second cut 42K2).

The exemplary structure illustrated in FIG. 11B will now be described.

Also in the exemplary structure illustrated in FIG. 11B, similar to the above-described case, the inclination angle of the downstream side surface 84 is smaller than the inclination angle of the upstream side surface 86.

In addition, in this exemplary structure, the downstream side surface 84 extends upstream in the rotation direction of the shaft 42*a*, and the inclination angle of the downstream side surface 84 does not change with increasing distance toward the upstream side.

The downstream side surface 84 is not necessarily formed such that the inclination angle thereof changes, and may have the same inclination angle at any position in the rotation direction of the shaft 42*a*.

The inclination angle of the downstream side surface 84 may be greater than 60°.

More specifically, the inclination angle of the downstream side surface 84 may be greater than 60° in the above-described region in which the inclination angle of the downstream side surface 84 is less than the inclination angle of the upstream side surface 86.

Others

Although the transport member included in the developing device 40 is described above as an example, the above-described transport member is not limited to a member for transporting the developer in the developing device 40. The transport member may instead be used to transport the developer in a cartridge that contains the developer, or be provided in a developer transport path that extends from the cartridge to the developing device. The above-described transport member may instead be used to transport, for example, waste toner.

In addition, although the transport member provided in the image forming apparatus 1 is described above, the above-described structure may instead be applied to an apparatus other than an image forming apparatus, and may be used to transport powder, particles, etc. other than developer. The above-described structure may also be used to transport, for example, a viscous body such as soft resin or a substance such as soil. In other words, the above-described structure may be applied to a resin extruder or an excavator.

The size of the transport object is also not particularly limited, and the above-described transport member may be used to transport objects having a large diameter by increasing the size thereof.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transporting member comprising:

a rotating shaft; and a plurality of helical blades that helically extend around the rotating shaft and that transport a transport object in a direction of the rotating shaft as the rotating shaft rotates, each helical blade including a downstream side surface at a downstream side in a transporting direction and an upstream side surface at a side opposite to the downstream side surface, wherein a portion of at least one of the helical blades has a gap that enables the transport object to move in the direction of the rotating shaft, and the at least one of the helical blades includes an upstream section that extends upstream in a rotating-shaft rotation direction, in which the rotating shaft rotates, from the gap, and wherein the upstream section includes a portion in which an inclination angle of the downstream side surface is less than an inclination angle of the upstream side surface.

2. The transporting member according to claim 1, wherein the portion in which the inclination angle of the downstream side surface is less than the inclination angle of the upstream side surface is provided at a portion of the upstream section that is positioned adjacent to the gap.

3. The transporting member according to claim 2, wherein the inclination angle of the downstream side surface of the upstream section gradually increases with increasing distance from the portion positioned adjacent to the gap toward an upstream side in the rotating-shaft rotation direction.

4. The transporting member according to claim 3, wherein the inclination angle of the downstream side surface of the portion in which the inclination angle of the downstream side surface is less than the inclination angle of the upstream side surface is greater than 60°.

5. The transporting member according to claim 2, wherein the inclination angle of the downstream side surface of the portion in which the inclination angle of the downstream side surface is less than the inclination angle of the upstream side surface is greater than 60°.

6. The transporting member according to claim 1, wherein the portion in which the inclination angle of the downstream side surface is less than the inclination angle of the upstream side surface is provided at a downstream end portion of the upstream section, the downstream end portion being positioned at a downstream side of the upstream section in the rotating-shaft rotation direction.

7. The transporting member according to claim 6, wherein the inclination angle of the downstream side surface of the upstream section gradually increases with increasing distance from the downstream end portion toward an upstream side in the rotating-shaft rotation direction.

8. The transporting member according to claim 7, wherein the inclination angle of the downstream side surface of the portion in which the inclination angle of the downstream side surface is less than the inclination angle of the upstream side surface is greater than 60°.

9. The transporting member according to claim 6, wherein the inclination angle of the downstream side surface of the portion in which the inclination angle of the downstream side surface is less than the inclination angle of the upstream side surface is greater than 60°.

10. The transporting member according to claim 1, wherein the downstream side surface of the upstream section includes a portion having an inclination angle that increases with increasing distance toward an upstream side in the rotating-shaft rotation direction.

11. The transporting member according to claim 10, wherein the inclination angle of the downstream side surface of the portion in which the inclination angle of the downstream side surface is less than the inclination angle of the upstream side surface is greater than 60°.

12. The transporting member according to claim 1, wherein the gap is a first gap, and the at least one of the helical blades also has a second gap that is disposed upstream of the first gap in the rotating-shaft rotation direction and that enables the transport object to move in the direction of the rotating shaft, and wherein the downstream side surface of the upstream section includes a first portion and a second portion in a region between the first gap and the second gap, the first portion being inclined, the second portion being closer to the second gap than the first portion is and having an inclination greater than an inclination of the first portion.

13. The transporting member according to claim 12, wherein the inclination angle of the downstream side surface of the portion in which the inclination angle of the downstream side surface is less than the inclination angle of the upstream side surface is greater than 60°.

14. The transporting member according to claim 1, wherein the inclination angle of the downstream side surface of the portion in which the inclination angle of the downstream side surface is less than the inclination angle of the upstream side surface is greater than 60°.

15. A developing device comprising:

the transporting member according to claim 1, the transporting member being used to transport developer, wherein the developing device forms an image on an image carrier.

16. An image forming apparatus comprising:

the transporting member according to claim 1, the transporting member being used to transport developer, wherein the image forming apparatus forms an image on a recording medium.

* * * * *